United States Patent [19]

Brugman

[11] 4,272,937

[45] Jun. 16, 1981

[54] PANEL CONSTRUCTION

[75] Inventor: Johannes Antonius H. Brugman, Rotterdam, Netherlands

[73] Assignee: Hunter Douglas International N.V., Curaco, Netherlands Antilles

[21] Appl. No.: 961,265

[22] Filed: Nov. 16, 1978

[30] Foreign Application Priority Data

Nov. 28, 1977 [DE] Fed. Rep. of Germany ..... 2752963
May 26, 1978 [GB] United Kingdom ..... 23416/78

[51] Int. Cl.[3] ..... E04B 5/52

[52] U.S. Cl. ..... 52/483; 52/484; 52/489; 52/665

[58] Field of Search ..... 52/478, 480, 482, 484, 52/489, 664, 665, 483, 506

[56] References Cited

U.S. PATENT DOCUMENTS

| | | | |
|---|---|---|---|
| 1,699,074 | 1/1929 | Louchs | 52/489 X |
| 3,253,375 | 5/1966 | Takehara | 52/478 |
| 3,452,500 | 7/1969 | Heirich | 52/478 |
| 3,596,420 | 8/1971 | Ducker | 52/478 X |
| 3,611,664 | 10/1971 | Barbera | 52/483 X |
| 3,628,298 | 12/1971 | Sickler | 52/483 X |
| 3,645,051 | 2/1972 | Kolesar | 52/484 X |

FOREIGN PATENT DOCUMENTS

| | | | |
|---|---|---|---|
| 496612 | 10/1950 | Belgium | 52/478 |
| 734139 | 5/1966 | Canada | 52/478 |

*Primary Examiner*—Carl D. Friedman
*Attorney, Agent, or Firm*—Pennie & Edmonds

[57] ABSTRACT

A panel construction, e.g. for wall or ceiling, in which a plurality of mutually parallel elongate support members, for example, of inverted T-shaped cross-section, have two parallel free longitudinal edges spaced apart from one another and elongate support elements which may, for example, be flat or channel section are carried by these support members. Clamps engage around the longitudinal edges of the support members and press the support elements against the support members and carry panel holding means which support a plurality of panels.

11 Claims, 13 Drawing Figures

PANEL CONSTRUCTION

BACKGROUND

The present invention relates to a panel construction suitable for forming or cladding a wall or ceiling.

One type of such panel construction includes elongate panels and one or more groups of mutually parallel supports, which each have, on their sides facing the panel surfaces, two parallel free longitudinal edges spaced from one another. The panels are in most cases fixed to the elongated supports and extend at a certain angle thereto, so that they cross the supports.

There are also constructions having several groups of mutually parallel supports, the groups of supports extending in directions different from one another and forming between them surface zones into which facings, for example in the form of coffers, are inserted.

It is the object of the present invention to provide a wall or ceiling design which can be mounted in a simple manner on parallel supports and the manufacture of which is cheap. At the same time, the design is also intended to be suitable for mounting a new facing with the lowest possible production expense, using supports which are already present, for example within the scope of renovation work, and using elongated panels or the like, even if there are groups of supports extending in different directions.

SUMMARY OF THE INVENTION

According to the invention there is provided a panel construction comprising a plurality of mutually parallel elongate support members, each having two parallel free longitudinal edges spaced apart from one another, elongate support elements carried by said support members, clamping means engaged around the longitudinal edges of the support members and pressing said support elements against said support members, panel holding means on said support elements and a plurality of panels held by said panel holding means.

Such a panel construction requires only low production costs and is also easy and simple to mount. In particular, it is also suitable for use with groups of mutually parallel support members which are already present. Should these groups of support members extend in different directions, the support member of one of these groups can be selected for fixing the support elements and the panels.

In the following text, several embodiments of the invention are described, one of which can consist in the clamps being integral parts of the particular support elements. As a result of their shaping, the latter can thus be used, utilizing their inherent resilience, in the manner of a clamp for fixing to the supports, parallel to the longitudinal axis.

According to a presently preferred embodiment of the invention, the clamping means are in the form of separate clamps, each comprising a central part engaging the support element, a side arm on each side of the central part and locking against the longitudinal edges of the support member and a compensating part on each side of the central part which extends away from the support element and joins the adjacent side arm. In this embodiment, the compensating parts which are lifted off from the support element, are capable of being elastically deformed to an adequate extent when they are mounted on the support members.

A further proposal according to the invention is that the side arms include inwardly bent locking parts which converge towards one another away from the ends of the arms remote from the central part. Whilst the diverging ends of the arms make it possible simply to slide them onto or over the longitudinal edges of the supports, the firm seating on the supports is effected by the inwardly bent locking parts. According to the invention this results in an advantageous design of the clamps, if the latter approximately have a W-shape, so that the outer legs can form the side arms, whilst the inner legs form the central part in their common transition region and otherwise form the compensating part which permits adequate deformation.

The support elements can be formed by flat strips which permit an adaptation to round or angular cross-sections of the support. For ceiling installations constructed in the customary manner, these support elements have, however, the disadvantage of a low inherent stiffness. By contrast, in a more advantageous embodiment, the support elements are of channel section configuration, comprising a central flat strip and two lateral strips inclined thereto, the width of the central strip being greater than that of the lateral strips, and wherein said holding means comprise lips bent out of said central strip at a preset spacing.

In an advantageous manner this results in a particularly flat shape of the support elements, provided the width of the central strip is thus at least twice that corresponding to the height of the bent lateral strips.

If desired, a plurality of support elements are carried by a support member and a bracket including a longitudinal portion is positioned within said channel cross-section strip and two arms engaged in an aperture formed in the central strip portion of two adjacent support elements to space the holding lips thereon at a preset spacing.

The use of a bracket of this type, with the fixing points on the support elements being arranged correspondingly, has the result that the fixing points and apertures can already be provided during the manufacture of the support elements and are always available even if the support elements are later cut to certain lengths. It is thus possible that two adjacent support elements can accurately be fixed in each case at such a longitudinal distance from one another that the screen spacing, which has been preset for the panels or their fixing means, can also be accurately maintained between the adjacent support elements.

It is thus no longer necessary to provide the recesses for the arms of the brackets only at the time of assembly.

If the support elements comprise a flat strip and the holding means comprise lips bent out of said flat strip, the clamping means may comprise side arms with inwardly directed locking parts on their free ends, said locking parts engaging around the longitudinal edges of the support member.

Advantageously, the clamps comprise a generally U-shaped resilient material element having, at the free end of the arms of the U, an outwardly directed arm having free ends, and an inwardly directed locking part on the free end of the arm, effective to clamp around the support element strip and the longitudinal edges of the support member. Preferably, the clamp is formed of resilient flat strip material, so that the outwardly projecting arms and the inwardly directed locking parts form a channel-shape on each arm, the open channel sides facing one another, the longitudinal axes of the channels being inclined in opposite senses with respect to the plane of the flat support element when the clamp is in a relaxed state prior to being put in place.

In the following text, the embodiments of the invention are described in detail, merely by way of example, reference being made to the accompanying drawings.

DETAILED DESCRIPTION OF PREFERRED EMBODIMENTS

The construction shown in FIGS. 1 to 7 has several mutually parallel support members 10, of which only one is shown here and which are suspended, for example, on suspension elements 11. The support members 10 each have an inverted T-shaped cross-section and forms two parallel free longitudinal edges 12.

Figure 1:
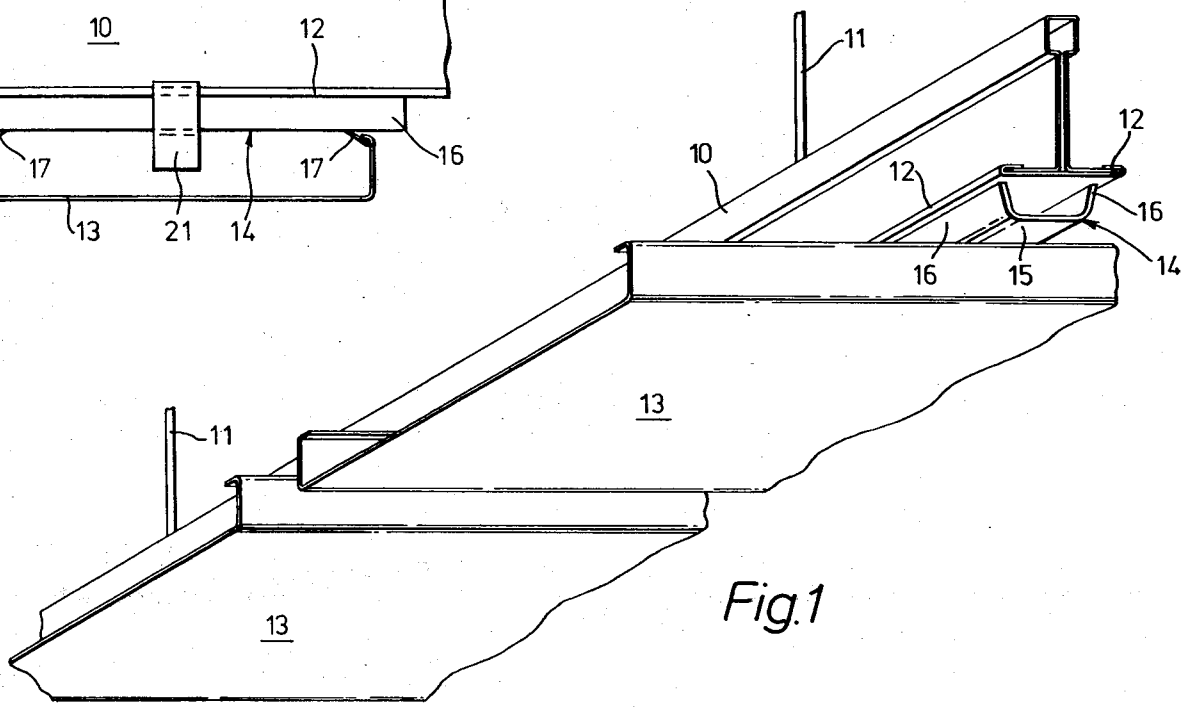
FIG. 1 is a perspective view of the presently considered best mode of panel construction according to the invention.
Figure 2:
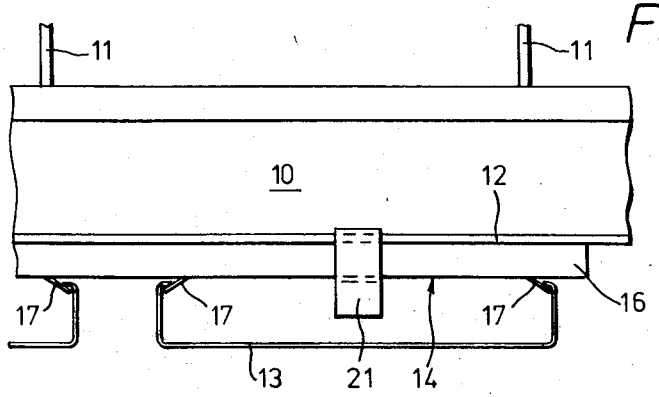
FIG. 2 is a partial end view of the construction of FIG. 1.

Parallel to the longitudinal axis of the support member 10, support elements 14 are fixed to its underside facing the panels 13 the support elements being of channel shaped cross-section having a central strip 15 and two bent-up lateral strips 16. The width of the central strip 15 is more than twice the width of a lateral strip 16. Lips 17 are punched out and bent out of the central strip 15 of the support elements 14. As can be seen in FIG. 2, these lips hold the panels 13. In order to give the latter a uniform distance from one another, the distance between the lips 17 is selected at an appropriate grid spacing.

The central strips 15 of the support elements 14 are provided with apertures 18, one arm 19 of each bracket 20 being able to engage in one of the apertures.

The pairs of lips 17, used for fixing a panel 13, have a preset grid spacing so that the resulting distance between two adjacent panels 13 is always equal. The distance of the apertures 18 and the arms 19 of the brackets from one another ensures this grid spacing. With the aid of the bracket 20, two adjacent support elements 14 can thus be fixed relative to one another in the longitudinal direction on the support 10 in such a way that the pairs of lips 17 of adjacent support elements 14 have the preset grid spacing, even if they are not in direct contact with one another.

Whilst the bracket 20 serves to fix the position of adjacent support elements 14 on a support member 10 in the axial direction, the actual fixing of the support elements 14 to the support member 10 is effected with the aid of clamps 21. The latter have a cross-section which is similar to a W-shape. Two divergent outer arms 22 are bent inwards at their ends and form locking parts 23, whilst a central part of the clamp 21 is formed by a bridge 25, which is adjoined on either side by divergent inner arms 24, corresponding to the W-shape.

In detail, the fixing of a support element 14 is thus effected as follows:

The particular support element 14 is placed against the underside of the support member 10 parallel to the latter. As can be seen in particular from FIG. 6, the clamp 21 is first slid, with the locking part 23 of one arm 22, over one longitudinal edge 12 of the support 10. Subsequently, the clamp 21 is pulled over in the direction of the opposite longitudinal edge 12. The inner arms 24, the bent transition region to the arms 22 and the arms 22 themselves represent a compensating part which makes it possible to deform the clamp 21 to such an extent that the latter can also be slid, by the second locking part 23, over the longitudinal edge 12 on the opposite side.

Figures 3, 4, 5, 6, 7:
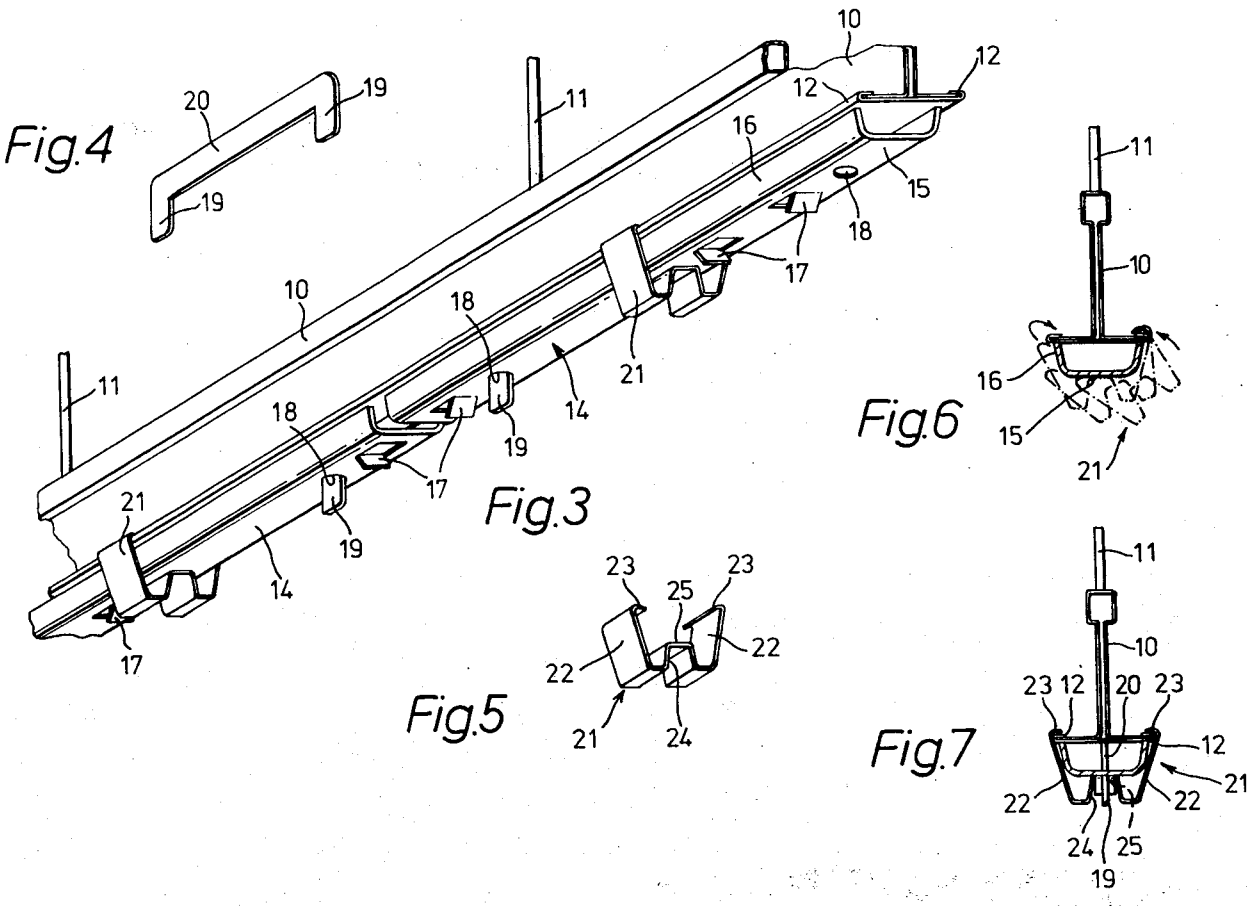
FIG. 3 is a perspective view of a part of a support member with mounted support elements.
FIG. 4 is a perspective view of a connector element of the construction of FIG. 1.
FIG. 5 is a perspective view of a clamp.
FIG. 6 is a schematic view showing the movement and deformation of such a clamp, when a support element is fixed to a support member.
FIG. 7 is a view similar to FIG. 6, showing the clamp in position on a support element.

The final mounted position of the clamp 21 is shown in FIG. 7. The central part formed by the bridge 25 lies against the underside of the central strip 15 of the support element 14 and thus presses the support element 14 against the underside of the support member 10. The region of the clamp 21, adjacent to either side of the bridge 25, is lifted off a little from the underside of the support element 14 and is given a distance from the latter, which approximately has the same magnitude as the height of the support element 14.

The height of the bracket 20 is such that the latter can be accommodated in the internal space of the support element 14.

Figures 8, 9, 10, 11, 12:
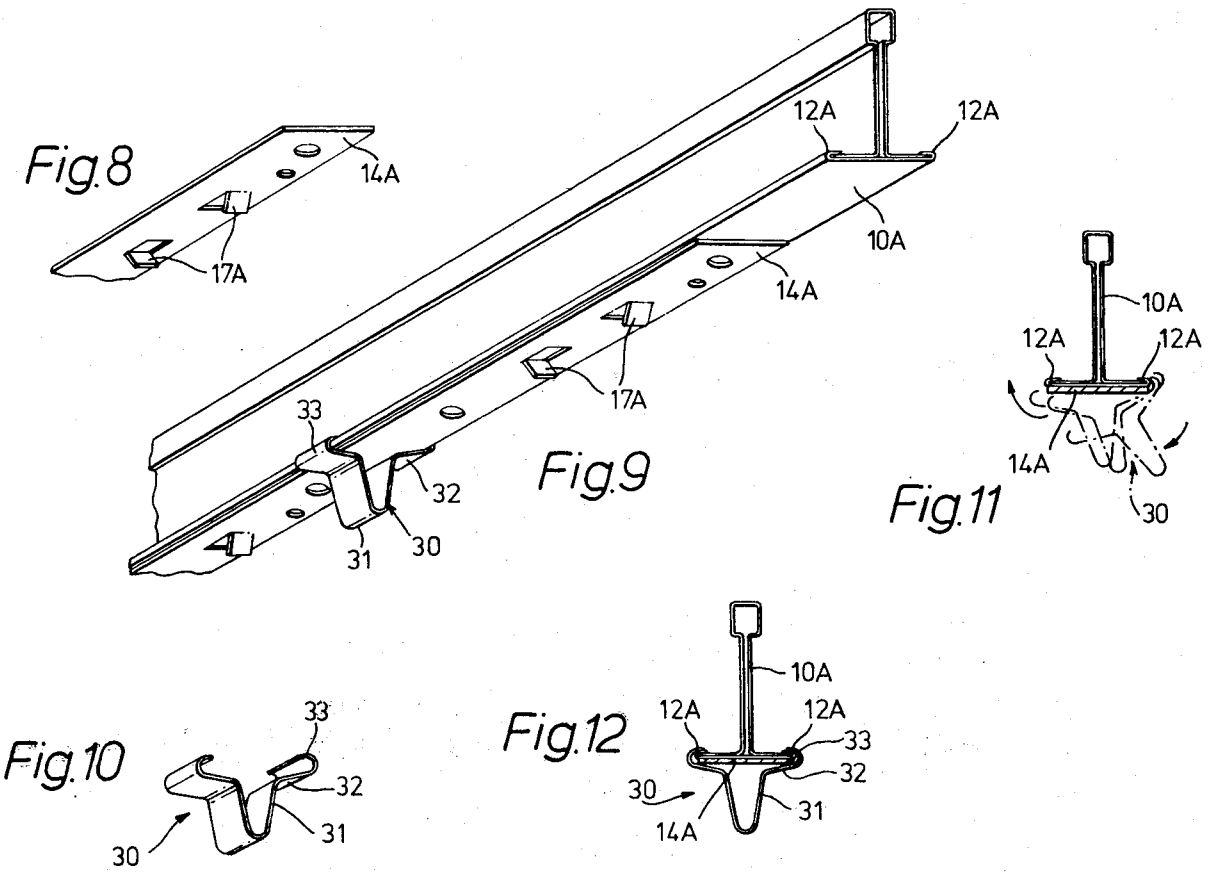
FIG. 8 is a perspective view of a portion of an alternative form of support element of a construction according to the invention.
FIG. 9 is a perspective view of the element of FIG. 8 in position on a support member.
FIG. 10 is a perspective view of a clamp illustrated in FIG. 9.
FIG. 11 is a view illustrating the clamp of FIG. 10 being put in place.
FIG. 12 is a similar view to FIG. 11 with the clamp in place.

FIGS. 8 and 9 illustrate a further form of support member and element in which like parts have been indicated by like reference numerals with the suffix A. Support element 14A is a flat strip with lugs 17A punched therefrom. The element 14A is held against the lower surface of the support member 10A, having spaced apart longitudinal edges 12A, by means of a clamp 30 illustrated in more detail in FIG. 10. This comprises a generally U-shaped portion 31, at the outer edges of the arms of which divergent arms 32 are provided. These divergent arms 32 are provided at their free ends with an inturned locking part 33. The ends of the arms 32 and the inturned locking part form, in effect, a channel section to accommodate the edges of the strip 14A and the edges 12A of the support 10A as indicated in FIG. 12.

Figure 13:
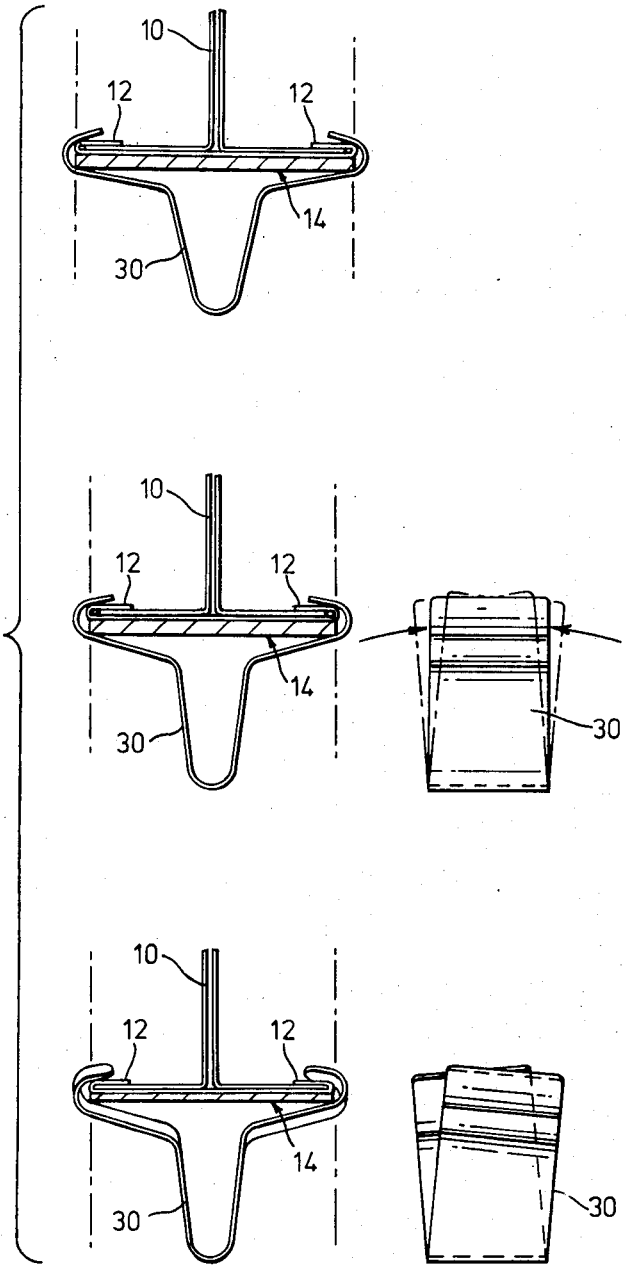
FIG. 13 illustrates two different thicknesses and two different widths of the lower part of the support member of FIG. 9 and how this is accommodated by different degrees of twist of the clamp of FIG. 10.

In the particular construction, illustrated in FIG. 13, the clamp 30 which is formed of a strip material which is resilient, is twisted in such a way that the channels formed by the ends of the arms 32 and the locking parts 33 have longitudinal axes which are angled in opposite senses to the plane of the support element strip 14A. This enables the same clamp to be used on support element strips of different thickness and/or support members of which the lower flange is of a different thickness.

Equally this form of strip can cope with a support element strip and/or a lower flange which is of a different width as indicated at the top of the drawing in FIG. 13.

It is preferred, but not essential, for the support elements 14, 14A and clamping means, that is the clamps 21, 30 to be of metal, for instance steel or aluminium.

Numerous modifications of the examples which have been described here are conceivable, without departing from the scope of the invention.

I claim:

1. A panel construction comprising a plurality of mutually parallel elongate support members, each having two parallel free longitudinal edges spaced apart from one another, elongate support elements carried by said support members, said support elements having their length aligned with and parallel to the length of said support members, a bracket means connecting adjacent support elements to maintain a predetermined spacing between said support elements, clamping means engaged around the longitudinal edges of the support members for pressing said support elements against said support members, a plurality of panel holding means on each support element and a plurality of panels held by said panel-holding members.

2. A panel construction as claimed in claim 1, wherein said clamps are integral parts of said support elements.

3. A panel construction as claimed in claim 1, wherein said clamping means are resilient.

4. A panel construction comprising a plurality of mutually parallel elongate support members, each having two parallel free longitudinal edges spaced apart from one another, elongate support elements carried by said support members, clamping means engaged around the longitudinal edges of the support members and pressing said support elements against said support members, panel-holding means on said support elements, a plurality of panels held by said panel-holding means, said clamping means being formed as separate clamps, each comprising a central part engaging the support element, a side arm on each side of the central part and locking against the longitudinal edges of the support member and a compensating part on each side of the central part which extends away from the support element and joins the adjacent side arm.

5. A panel construction as claimed in claim 4, wherein the clamping means have an approximately W-shaped cross-section.

6. A panel construction as claimed in claim 4, wherein said side arms further comprise inwardly bent locking parts which converge towards one another away from the ends of the arms remote from the central part.

7. A panel construction comprising a plurality of mutually parallel elongate support members, each having two parallel free longitudinal edges spaced apart from one another, elongate support elements carried by said support members, clamping means engaged around the longitudinal edges of the support members and pressing said support elements against said support members, panel-holding means on said support elements, a plurality of panels held by said panel-holding means, said support elements being of channel section configuration comprising a central flat strip and two lateral strips inclined thereto, the width of the central strip being greater than that of the lateral strips, and said holding means comprising lips bent out of said central strip at a preset spacing.

8. A panel construction comprising a plurality of mutually parallel elongate support members, each having two parallel free longitudinal edges spaced apart from one another, elongate support elements carried by said support members, clamping means engaged around the longitudinal edges of the support members and pressing said support elements against said support members, panel-holding means on said support elements, a plurality of panels held by said panel-holding means, said support elements comprising a flat strip mounted on the support mmber, the holding means comprising lips bent out of said flat strip and said clamping means comprising resilient strips each comprising side arms with inwardly directed locking parts on their free ends, said locking parts engaging around the longitudinal edges of the support member.

9. A panel construction as claimed in claim 8, wherein the clamps comprise a generally U-shaped resilient material element having, at the free ends of the arms of the U, an outwardly directed arm having free ends, and an inwardly directed locking part on the free end of the arm, effective to clamp around the support element strip and the longitudinal edges of the support member.

10. A panel construction according to claim 9, wherein said clamp is formed of resilient flat strip material, so that the outwardly projecting arms and the inwardly directed locking parts form a channel shape on each arm, the open channel sides facing one another, the longitudinal axes of the channels being inclined in opposite senses with respect to the plane of the flat support element when the clamp is in a relaxed state prior to being put in place.

11. A panel construction comprising a plurality of mutually parallel elongate support members, each having two parallel free longitudinal edges spaced apart from one another, elongated support elements carried by said support members, clamping means engaged around the longitudinal edges of the support members for pressing said support members against said support elements, panel holding means on said support elements and a plurality of said panels held by said panel holding means; said panel elements being of channel section configuration comprising a central flat strip and two lateral strips inclined thereto with the width of the central strip being greater than the width of the lateral strips, said holding means comprising lips bent out of said central strip at a present spacing, a plurality of support elements being carried by a support member and further comprising a bracket including a longitudinal portion positioned within said channel cross section strip and two arms being engaged in an aperture formed in the central strip portion of two adjacent support elements to space the holding lips thereon at a present spacing.

* * * * *